United States Patent [19]

Vincent

[11] 4,090,694

[45] May 23, 1978

[54] GO-CART GUARD RAIL

[76] Inventor: Clarence K. Vincent, 3023 Tilden, Houston, Tex. 77025

[21] Appl. No.: 814,193

[22] Filed: Jul. 11, 1977

[51] Int. Cl.[2] ..... A01K 3/00; E01F 15/00

[52] U.S. Cl. ..... 256/13.1

[58] Field of Search ..... 256/13.1, 1, 14, 15; 114/219; 248/66

[56] References Cited

U.S. PATENT DOCUMENTS

| | | | |
|---|---|---|---|
| 3,661,359 | 5/1972 | Walker | 114/219 |
| 3,664,653 | 5/1972 | Walker | 114/219 |
| 3,848,853 | 11/1974 | Way et al. | 256/13.1 |
| 3,863,589 | 2/1975 | Guienne et al. | 114/219 |
| 3,934,540 | 1/1976 | Bruner et al. | 256/1 |
| 3,951,384 | 4/1976 | Hildreth | 256/1 |
| 4,022,452 | 5/1977 | Dupre | 256/1 |
| 4,030,706 | 6/1977 | Ward | 256/1 |

*Primary Examiner*—Ronald Feldbaum

[57] ABSTRACT

A resilient guard rail assembly for use on one or both sides of a go-cart track, at dangerous curves or embankments to inhibit a go-cart from overrunning the track; said guard rail assembly including vehicle tires disposed in a tread to tread relationship with one side-wall of each tire engaging a surface, such as, the upper surface of the track. This guard rail assembly comprises a substantially continuous, ribbon-like, flexible, resilient rail section yieldingly spaced from a stationary anchor by a deformable vehicle tire which deforms or has a tendency to flex sideways, thereby absorbing substantially all of the energy transferred thereto incident to a collision thereagainst by a rapidly moving go-cart, whereby there is substantially no damage to the go-cart or the driver thereof.

11 Claims, 2 Drawing Figures

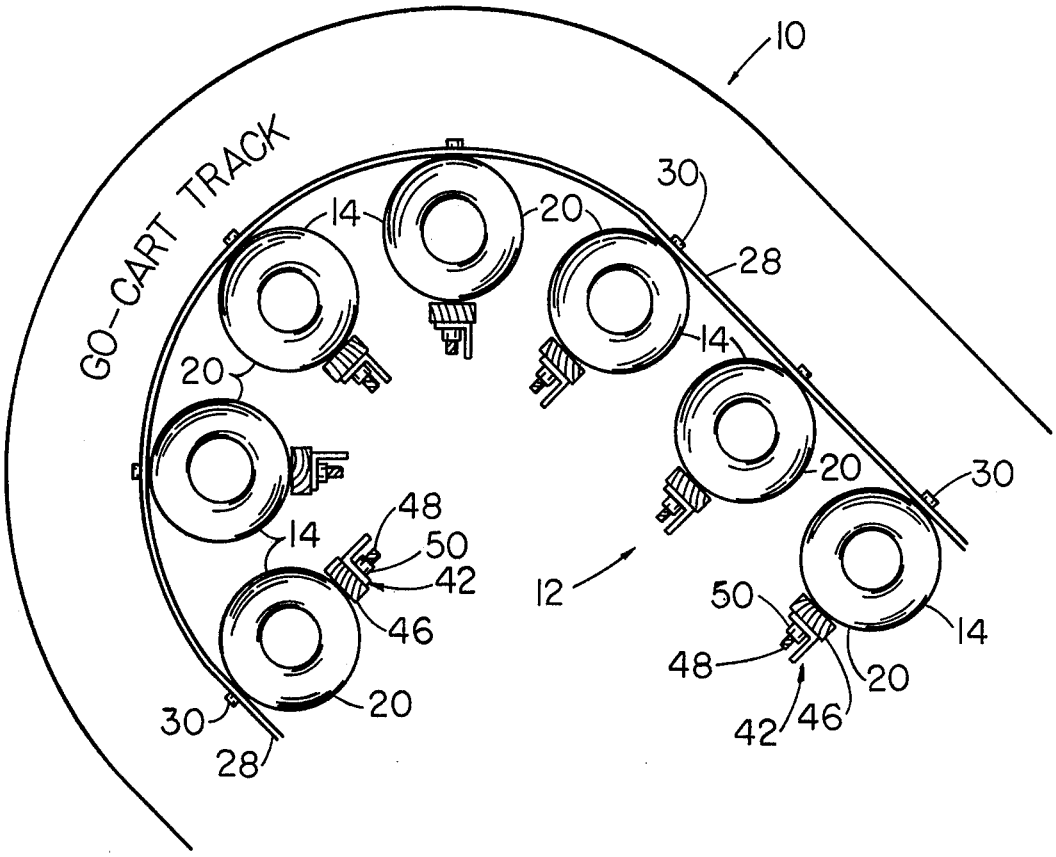
FIG. I
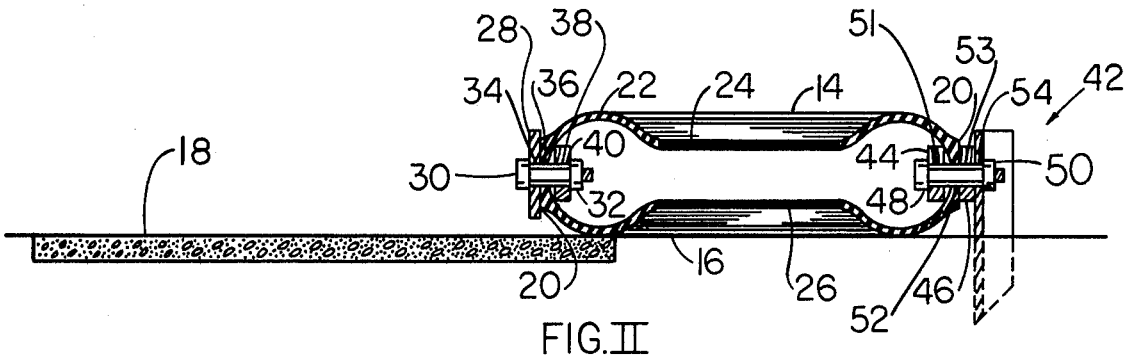
FIG. II

GO-CART GUARD RAIL

The inventive concept relates to a flexible resilient guard rail assembly for arresting and/or attenuating the energy and/or force of a rapidly moving go-cart in collision thereagainst; thereby preventing injury to the driver and property damage to said go-cart.

The following representative art was garnered in a search of the U.S. Patent Office: (1) 1,795,247 to Burns; (2) 1,922,878 to Boyle; (3) 3,661,359 to Walker and (4) 3,848,853 to Way et al.

In the past, efforts have been expended to develop a satisfactory, simple, economical, easily assembled, rugged and reliable go-cart guard rail assembly. Some present day practices have been to line the track with bales of hay. Such bales of hay, however, are knocked away from the edge of the go-cart track when struck by a speeding go-cart and loose their effectiveness until they are manually repositioned adjacent the edge of said track. Used auto tires, likewise, have been placed adjacent the edge of a go-cart track but they suffer the same deficiencies as the aforementioned bales of hay. Thus, it is obvious, in view of the inadequateness of the above noted practices, that a satisfactory solution has not been previously discovered.

Accordingly, a major object of the present inventive concept is to provide a flexible go-cart guard rail which, because of its compactness, reliability and simplicity of design, has a field of its own; as this type of go-cart track guard rail assembly can be readily installed, at reasonable expense, on any desired go-cart track in a minimum time span, and there is no need for specially constructed foundations.

Another object of the present invention is to provide a go-cart track guard rail assembly which can be kept operational with a minimum of downtime due to malfunction of said assembly; thus personnel can work on other jobs, thereby increasing savings in manpower even more.

A still further object of the present invention is to provide a go-cart track guard rail assembly which is simple to fabricate, reliable in operation and is so constructed and arranged to substantially absorbe all the forces created by the impact of a go-cart thereagainst with substantially minimum rebound and/or reaction, and gently direct said go-cart back onto the go-cart track.

Other objects and purposes of the present invention will be apparent to persons acquainted with GO-CART GUARD RAILS of this general type upon reading the following specification in conjunction with the accompanying drawing:

In the drawing:

FIG. I is a plan view of the go-cart guard rail device of the present inventive concept.

FIG. II is a sectional elevation of the present inventive concept.

Certain terminology will be used in the following description for convenience in reference only and will not be limiting. The words "upwardly", "downwardly", "rightwardly" and "leftwardly" will designate directions in the drawing in which reference is made. The words "fore" and "aft" or "inwardly" and "outwardly" will refer to directions toward and away from, respectively, the geometric center of the Go-Cart Guard Rail and designated parts thereof. Said terminology will include the words above specifically mentioned, derivatives thereof and words of similar import.

Further, it will be understood that the following description of the Go-Cart Guard Rail and operation of certain portions thereof, has been selected for illustrative purposes only as a convenient and appropriate means for acquainting those skilled in the art with the present invention.

DESCRIPTION OF PREFERRED EMBODIMENT

A general arrangement representing a preferred embodiment of the present inventive concept is illustrated in the drawing. Reference is now made in greater detail to FIGS. I and II wherein like numerals indicate similar parts or portions throughout the several views. FIG. I discloses a go-cart track 10 having the present go-cart guard rail assembly 12 mounted on at least one side of track 10 and said assembly 12 substantially following the geometric configuration or periphery of the go-cart track 10. The guard rail assembly comprises a plurality of vehicle tires 14 positioned in a spaced apart, tread to tread relationship with at least one side-wall 16 resting on the upper surface 18 of track 10 and/or on the ground adjacent said track 10. The side-wall 16, however, is substantially parallel and on substantially the same horizontal plane as the upper surface 18 of track 10. The conventional vehicle tire 14 comprises a substantially cylindrical outer wall 20 which defines the tread portion thereof; a pair of spaced apart, convex side-walls 16, 22 connected to opposite sides of the tread portion and extending between said tread portion and a pair of spaced apart, circular bead portions 24, 26. A relative thin, ribbon-like, flexible, metallic, guard rail 28 is supported by and fixedly secured to each tire by conventional fastener means which includes a carriage bolt 30 with a complementary nut 32. This bolt 30 extends into and through axially aligned openings 34, 36 and 38 which are bored through guard rail 28, the outer wall 20 of tire 14 and a rectangular plate member 40 respectively. In the present concept, the plate member 40 is fabricated from lumber; however, metal or any conventional material having sufficient strength can be employed. Plate 40 is positioned within tire 14 to reinforce the tire area adjacent the point where guard rail 28 is secured to tire 14. The guard rail 28 is attached to tire 14 on one side thereof, while on substantially the opposite side of tire 14 there is positioned a stationary anchor means 42 which is fabricated from a length of structural steel angle iron; however, other types of conventional anchors can be utilized if desired. A pair of reinforcing rectangular plate members 44, 46 are positioned in opposed relationship on opposite sides of the tread of tire 14. Reinforcing plate 44 is disposed on the inside of tire 14 and reinforcing plate 46 is positioned on the outer tread surface of tire 14, interjacent the tread of tire 14 and anchor means 42. The two reinforcing plates 44, 46, a segment or portion of the tread area of tire 14 and stationary anchor 42 are fixedly secured together by fastening means which comprises a carriage bolt 48 and complementary nut 50. The bolt 48 extends into and through aligned openings 51, 52, 53 and 54 which are drilled through plate 44, the outer wall 20 of tire 14, plate 46 and anchor means 42, respectively. The anchor 42 is shown in the drawing as being positioned on the opposite side of tire 14 from the location where rail 28 is secured to said tire 14. The present guard rail assembly 12 will effectively function with the anchor means 42 positioned in substantially any desired location around the periphery of tire 14. In fact, two or more anchors can be attached to each tire 14 if desired.

The two opposed reinforcing plates 44, 46 cooperate with anchor 42 for positioning side-wall 16 substantially parallel to the upper surface 18 of track 10. For example, assume the ground or grade adjacent one side of track 10 drops downwardly away from surface 18. The tires 14 that support rail 28 will be upwardly inclined relative to surface 18; thus by elevating or upwardly adjusting anchor 42 the side-wall 16 can be adjusted to a substantially parallel relationship with surface 18. The reinforcing plates 44, 46 function to strengthen that segment of the tire 14, adjacent anchor 42, and rigidly secure the tire 14 to said anchor 42.

While the invention has been shown, illustrated, described and disclosed in terms of embodiments or modifications which it has assumed in practice, the scope of the invention should not be deemed to be limited by the precise embodiment or modification therein shown, illustrated, described or disclosed; such other embodiments or modifications intended to be reserved especially as they fall within the scope of the claims here appended.

It will further be understood that the "Abstract of the Disclosure" set forth above is intended to provide a non-legal technical statement of the disclosure in compliance with the Rules of Practice of the United States Patent Office, and is not intended to limit the scope of the invention described and claimed herein.

What is desired to be secured and claimed by Letters Patent of the United States is:

1. A safety apparatus to be utilized on a go-cart track, with said apparatus structurally fabricated as a guard rail assembly which is so constructed and arranged to attenuate the impact energy imparted thereto when a rapidly moving go-cart collides thereagainst, in combination comprising:

at least two vehicle tires disposed in a tread to tread relationship along at least one side and substantially following the geometric configuration of a go-cart track, each tire having a substantially cylindrical outer wall defined by the tread portion thereof, with a pair of opposed, spaced apart, substantially convex side-walls connected to opposite sides of the tread portion, with each side-wall extending between said tread portion and a substantially circular bead portion of the tire;

a substantially continuous, flexible, ribbon-like guard rail means having a portion disposed in a side by side relationship with a segment of the outer tread surface of each tire, said guard rail means including means for securing the ribbon-like guard rail to each tire, with said flexible guard rail extending substantially uninterruptedly from one tire to an adjacent tire; and each tire being fixedly secured to a stationary anchor means.

2. The guard rail assembly recited in claim 1, wherein the substantially continuous, flexible ribbon-like guard rail means includes means for fixedly securing said guard rail to a segment of the outer tread surface of each tire, with said flexible guard rail extending substantially uninterruptedly from the segment of one tire to at least another segment of an adjacent tire.

3. The guard rail assembly recited in claim 2, wherein the means for securing the guard rail to the segment of the outer tread surface of each tire includes said outer tread surface defining a first opening extending therethrough, with the flexible, ribbon-like guard rail defining another opening extending therethrough, said openings disposed in opposed, axially aligned relationship and fastener means extending into and through both openings for fixedly securing the flexible, ribbon-like guard rail to the segment of the outer tread surface of each tire.

4. The guard rail assembly recited in claim 1, further including means for reinforcing the interior of each tire opposite the segment of the outer tread surface of each tire.

5. The guard rail assembly recited in claim 4, wherein the reinforcing means comprises a rectangular structural plate member having a length greater than its width.

6. The guard rail assembly recited in claim 3, further including reinforcing means to strengthen each tire opposite the segment of the outer tread surface of each tire.

7. The guard rail assembly recited in claim 1, further including reinforcing means to strengthen each tire opposite the stationary anchor means.

8. The guard rail assembly recited in claim 6, wherein, the reinforcing means comprises a reinforcing plate means disposed within the interior of each tire and opposite the segment of the outer tread surface of each tire.

9. The guard rail assembly recited in claim 8, wherein the reinforcing plate means defines an opening extending therethrough with said opening disposed in axially aligned relationship with the first opening and said another opening, with said fastener means extending into and through all three openings for fixedly securing the flexible, ribbon-like guard rail to the segment of the outer tread surface of each tire.

10. The guard rail assembly recited in claim 7, wherein the reinforcing means comprises a reinforcing plate means disposed within the interior of each tire adjacent the stationary anchor means; and fastener means so constructed and arranged to fixedly secure said reinforcing plate means to the stationary anchor means.

11. A safety apparatus to be utilized on a go-cart track, with said apparatus structurally fabricated as a guard rail assembly which is so constructed and arranged to attenuate the impact energyimparted thereto when a rapidly moving go-cart collides thereagainst, in combination comprising:

at least two vehicle tires disposed in a tread to tread relationship along at least one side and substantially following the geometric configuration of a go-cart track.

a substantially continuous, flexible, ribbon-like guard rail means having a portion disposed in a side by side relationship with a segment of the outer tread surface of each tire;

means for securing the ribbon-like guard rail to each tire, with said flexible guard rail extending substantially uninterruptedly from one tire to an adjacent tire;

means for reinforcing each tire adjacent said segment of the outer tread surface of each tire;

each tire being fixedly secured to a stationary anchor means; and means for reinforcing each tire adjacent the stationary anchor means.

* * * * *